US007134898B2

(12) United States Patent
Ma

(10) Patent No.: US 7,134,898 B2
(45) Date of Patent: Nov. 14, 2006

(54) LAND GRID ARRAY CONNECTOR ASSEMBLY

(75) Inventor: Hao-Yun Ma, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/000,569

(22) Filed: Nov. 30, 2004

(65) Prior Publication Data

US 2005/0130478 A1 Jun. 16, 2005

(30) Foreign Application Priority Data

Dec. 12, 2003 (TW) ..... 92221832 U

(51) Int. Cl.
*H01R 13/625* (2006.01)

(52) U.S. Cl. ..... 439/342; 439/331

(58) Field of Classification Search ..... 439/331, 439/341, 342, 261, 264
See application file for complete search history.

(56) References Cited

U.S. PATENT DOCUMENTS 6,685,494 B1 * 2/2004 McHugh et al. ..... 439/342
6,716,050 B1 * 4/2004 Ma et al. ..... 439/331

* cited by examiner

*Primary Examiner*—Chandrika Prasad
(74) *Attorney, Agent, or Firm*—Wei Te Chung

(57) ABSTRACT

An LGA connector assembly (1) includes an insulative housing (10), a plurality of terminals (12) received in the housing, a metal clip (40) having a pressing portion (421) assembled on the housing. The housing defines a first sidewalls (11) and a second sidewall (15) and two other sidewalls (16, 17) opposite to the first and second sidewalls respectively. The four sidewalls each define two protrusions (18, 19) extending from a corresponding inner face thereof. One protrusion defined on the first and second sidewalls is adjacent to the pressing portion and far away from a corner connecting the first and second sidewalls, the other protrusions each define on the corresponding corners connecting the sidewalls.

7 Claims, 6 Drawing Sheets

LAND GRID ARRAY CONNECTOR ASSEMBLY

BACKGROUND OF THE INVENTION

1. Field of the Invention

The present invention relates to the art of electrical connectors, and more particularly to a land grid array (LGA) connector assembly provided for mechanically and electrically connecting the LGA chip to a printed circuit board (PCB).

2. Description of the Prior Art

LGA electrical connectors are widely used in the connector industry for electrically connecting LGA chips to printed circuit boards (PCBs) in personal computers (PCs). Conventionally, an LGA connector mainly comprises an insulative housing, a multiplicity of terminals received therein, a load plate and a cam lever pivotably mounted on two opposite sides of the housing. The housing defines a multiplicity of terminal passageways in a rectangular array, for interferentially receiving corresponding terminals. Due to the very high density of leads arranged on an LGA chip, the LGA chip needs to be precisely seated on the LGA connector. Thus it is difficult to ensure reliable signal transmission between the terminals and the LGA chip.

Referring to FIGS. 4–6, a conventional land grid array connector assembly 8 comprises an insulative housing 82, a plurality of terminals 81 received in the housing 82, a metal stiffener 83 partly covering and reinforcing the housing 82, a load plate 84 pivotably received in an end of the stiffener 83, and a cam lever 85 pivotably mounted to an opposite end of the stiffener 83 for engaging with the cam lever 85. The housing 82 defines four sidewalls 820 and a central cavity disposed between the sidewalls 820. The central cavity is used for receiving a land grid array (LGA) chip 100 therein. A distal end of the terminal 81 is formed outward from a top surface of the central cavity, for being pressed to engage with a corresponding lead of the LGA chip 100. The load plate 84 comprises two opposite sides 840. A pair of pressing portions 841 is provided in respective middle portions of the sides 840, for pressing the LGA chip 100 engaging with the terminals 81. A pair of protrusions 821 is provided in respective opposite ends of the sidewalls 820. The protrusion 821 extends from an inner face of the sidewall 821 toward to the central cavity for securing the LGA chip 100 in the central cavity. When the LGA chip 100 engages with the connector assembly 8, the load plate 84 is rotated upward. The LGA chip 100 is placed in the central cavity of the housing 82. The load plate 84 is rotated from a vertical portion to a horizontal portion to make the two opposite sides 840 of the load plate 84 attach on corresponding sides of the LGA chip 100. The cam lever 85 is rotated to drive the load plate 84 to gradually approach the housing 82 until the pressing portions 841 of the sides 840 press the LGA chip 100 downwardly to make the leads of the LGA chip 100 contact with the distal ends of the terminals 81 and make the sides of the LGA chip 100 attach corresponding protrusions 821 and secure the LGA chip 100 in the protrusions 821 therebetween. As a result, mechanical and electrical engagement between the terminals 81 and corresponding leads (not shown) of the LGA chip 100 is attained.

However, because the protrusion 821 is formed at two ends of the sidewall 820, when the pressing portions 841 of the load plates 84 press on the LGA chip 100, the pressing force applied on the LGA chip 100 will generate friction at a junction of the sides of the LGA chip 100 engaged with the protrusions 821. The friction is prone to make the LGA chip 100 move upwardly relative to the housing 82 at a interface of the protrusion 821 and the side of the LGA chip 100 in vertical direction and spaces are formed between the leads of the LGA chip 100 and the terminals 81. As a result, the reliability of the mechanical and electrical engagement between the leads of the LGA chip 100 and the terminals 81 is decreased. If this happens, the LGA chip 100 can not be secured between the sidewalls reliably, and some terminals 81 are prone not to fully engage the corresponding leads of the LGA chip 100. Uniform engagement between the terminals 81 and the corresponding leads of the LGA chip 100 is destroyed, and even open electrical circuits are liable to establish therebetween. Thus, the reliability of the mechanical and electrical engagement between the terminals 81 and the corresponding leads of the LGA chip 100 is decreased.

Thus, there is a need to provide a new land grid connector assembly that overcomes the above-mentioned problems.

SUMMARY OF THE INVENTION

Accordingly, an object of the present invention is to provide a land grid array (WA) connector assembly with dual-function protrusions able to ensure that leads of an electrical package electrically connect with the respective terminals of the LGA connector assembly steadily.

To fulfill the above-mentioned object, an LGA connector assembly in accordance with a preferred embodiment comprises an insulative housing, a plurality terminals received in the housing, a metal stiffener engaged with the housing, a metal clip and a cam lever pivotably mounted on two opposite sides of the stiffener. The housing defines a generally rectangular cavity for receiving an electronic package such as an LGA central processing unit (CPU) therein. A multiplicity of terminal-passages is defined in a portion of the housing under the cavity, for receiving a corresponding number of the terminals therein. The clip defines a pressing portion at two opposite sides for pressing the LGA chip upon the terminals. The housing defines a first sidewall, a second sidewall adjacent to the first sidewall, a third sidewall opposite to the first sidewall and a forth sidewall opposite to the second sidewall. A corner is A formed at an end of the first sidewall interconnecting the second sidewall. A pair of first protrusions is defined at a first corner connecting the second sidewall and the third sidewall, and a pair of first protrusions is defined at a second corner connecting the third sidewall and forth sidewall, while a pair of first protrusions is also defined at a third corner connecting the forth sidewall and the first sidewall. A second protrusion is also respectively defined almost at a corresponding middle portion of the first and second sidewalls. A distance between the second protrusions is larger than that of between each pair of first protrusions at first, second and third corners, but a distance of between each pair of first protrusions at first, second and third corners is equal. At the same time, a distance between the second protrusion and the corner A is larger than that of between one first protrusion and a corresponding corner. The first and second protrusions are used to secure the LGA chip in the cavity. When the LGA chip is mounted onto the housing, the metal clip presses the respective two portions of the LGA chip to make the leads of the LGA chip electrically connect with the terminals in the housing, the pressing force applied on the LGA chip will make the WA chip rotate about the first and second corners opposite to the corner A downward, and the pressing force applied on the LGA chip will produce frictional forces at an junction between the sides of the LGA chip and the second protrusions. The frictional forces is prone to make the LGA chip rotate about the first and second corners opposite to the corner A upwardly relative to the housing. Because the distance between the corner A and the second protrusion is larger than that of between the first corner and the first protrusion at the first corner and adjacent to the pressing portion of the metal clip, the degree of rotation of the fiction is smaller than the conventional degree of the rotation, thereby reliably electrical and mechanical engagement at the corner A is obtained.

Other objects, advantages and novel features of the present invention will become more apparent from the following detailed description when taken in conjunction with the accompanying drawings, in which:

DESCRIPTION OF PREFERRED EMBODIMENT OF THE INVENTION

Reference will now be made to the drawings to describe the present invention in detail.

Figure 1:
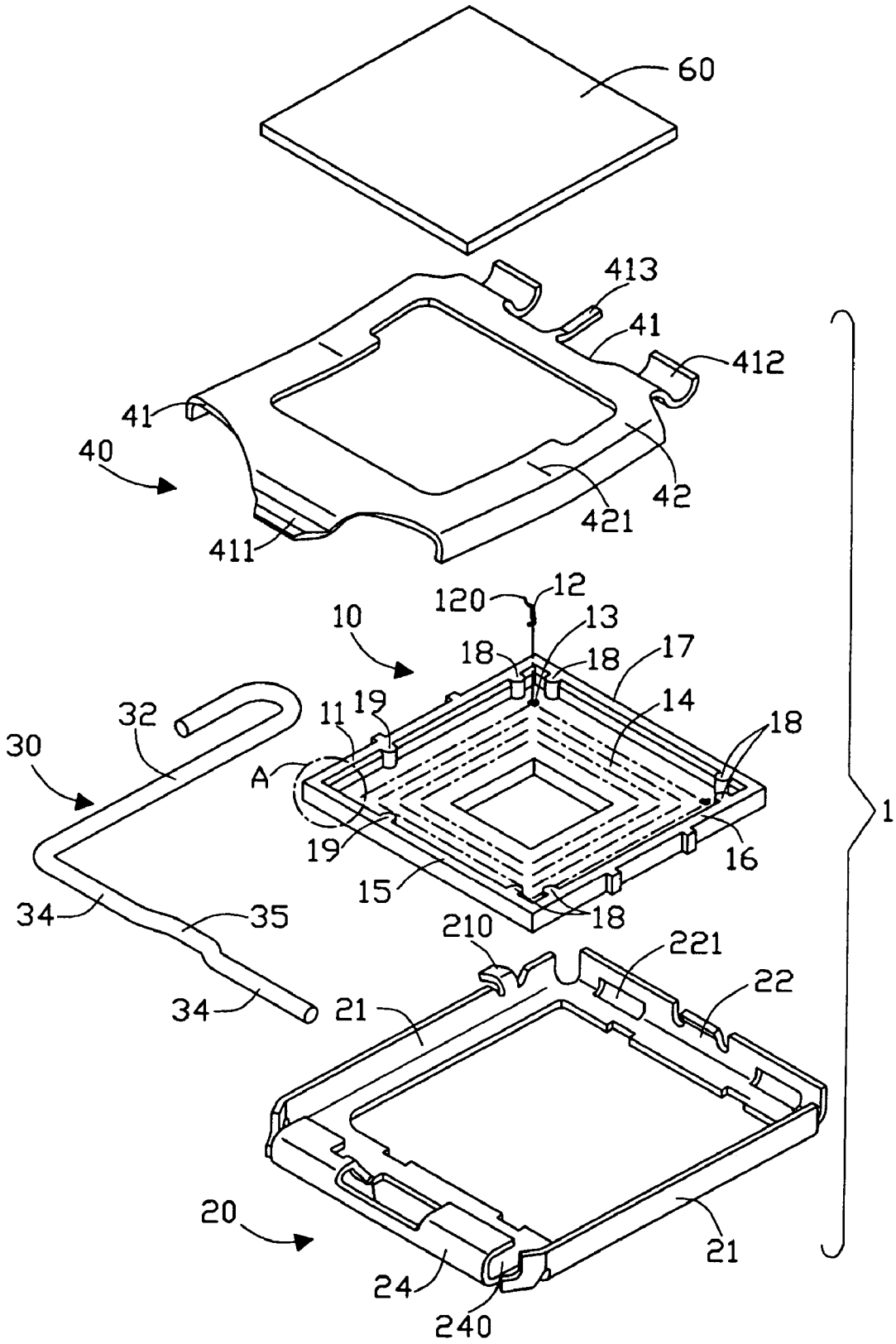
FIG. 1 is an exploded, isometric view of a land grid connector assembly in accordance with a preferred embodiment of the present invention, together with an LGA chip ready to be mounted in a housing of the connector assembly.

FIG. 1 is an exploded, isometric view of a land grid array (LGA) connector assembly 1 in accordance with a preferred embodiment of the present invention. The LGA connector assembly 1 provided for electrically connecting an LGA chip 60 to a PCB (not shown) comprises an a generally rectangular insulative housing 10, a multiplicity of terminals 12 received in the housing 10, a metal stiffener 20 partly covering and reinforcing the housing 10, a cam lever 30 pivotably received in an end of the stiffener 20, and a metal clip 40 pivotably mounted to an opposite end of the stiffener 20 for engaging with the cam lever 30.

The housing 10 defines a first sidewall 11, a second sidewall 15 interconnecting with the first sidewall 11, a third sidewall 16 opposite to the first sidewall 11, a forth sidewall 17 opposite to the second sidewall 15, and a generally rectangular cavity 14 in a middle thereof. The cavity 14 is used for receiving the LGA chip 60 therein. A multiplicity of terminal-passages 13 is defined in a portion of the housing 10 under the cavity 14, for receiving a corresponding number of the terminals 12 therein respectively. A corner A is formed between a junction between the first sidewall 11 and the second sidewall 15. A pair of first protrusions 18 is defined at a first corner connecting the second sidewall 15 and the third sidewall 16, and a pair of first protrusions 18 is defined at a second corner connecting the third sidewall 16 and forth sidewall 17, while a pair of first protrusions 18 is also defined at a third corner connecting the forth sidewall 17 and the first sidewall 11. A second protrusion 19 is also respectively defined almost at a corresponding middle portion of the first and second sidewalls 11, 15. A distance between the second protrusions 19 at corner A is larger than that of between each pair of first protrusions 18 at first, second and third corners, but a distance of each pair of first protrusions 18 at first, second and third corners is equal. At the same time, a distance between the second protrusion 19 and the corner A is larger than that of between one first protrusion 18 and a corresponding corner. That is to say, a distance between the first and second protrusions 18, 19 of the first sidewall 11 is smaller than that of between a pair of first protrusions 18 of the third sidewall 16. The first and second protrusions 18, 19 extend from an inner face of the corresponding sidewalls toward to the cavity 14 and has a semi-cylindrical cross-sectional. The first and second protrusions 18, 19 can secure the LGA chip 60 in the cavity 14 to connect the terminal 12. Each terminal 12 has a first contacting portion 120 protruding outwardly from a top face of the housing 10, for resiliently electrically contacting a corresponding pad of the LGA chip 60.

The stiffener 20 comprises a pair of lateral sides 21 each having an L-shaped cross-section, a front end 24 having a U-shaped cross-section, and a rear end 22 having a substantially L-shaped cross-section. The housing 10 is fittingly received in the stiffener 20. An elongate chamber 240 is defined in the front end 24 of the stiffener 20. A pair of spaced slots 221 is defined in the rear end 22 of the stiffener 20. A locking hook 210 extends arcuately from an edge of one of the lateral sides 21 of the stiffener 20.

The lever 30 comprises a pair of locating portions 34 pivotably received in the chamber 240 of the stiffener 20, an offset actuating portion 35 between the locating portions 34, and an operating portion 32 extending perpendicularly from an end of one of the locating portions 34. The operating portion 32 is disposed outside of the stiffener 20. When oriented at a horizontal position parallel to the housing 10, the operating portion 32 engages with the locking hook 210.

The clip 40 has two opposite first slant sides 41 and two opposite second slant sides 42 bent to the housing 10 and adjacent the first sides 41, respectively. An engaging portion 411 is extended arcuately from one of the first sides 41 thereof. A pair of spaced securing portions 412 is extended arcuately from the other of the first sides 41 thereof and pivotably received in the slots 221 of the stiffener 20, and a tail 413 between the securing portions 412. A pressing portion 421 is bent to the housing 10 in a middle portion of the second side 42. The pressing portion 421 can press the LGA chip 60 onto the terminals 12. When the clip 40 is oriented at the horizontal position, the engaging portion 411 of the clip 40 engages with the actuating portion 35 of the lever 30, thereby pressing the LGA chip 60 on the terminals 12. When the clip 40 is oriented at a vertical position perpendicular to the housing 10, the tail 413 abuts against the stiffener 20 to prevent the clip 40 from being over-rotated.

Figure 2:
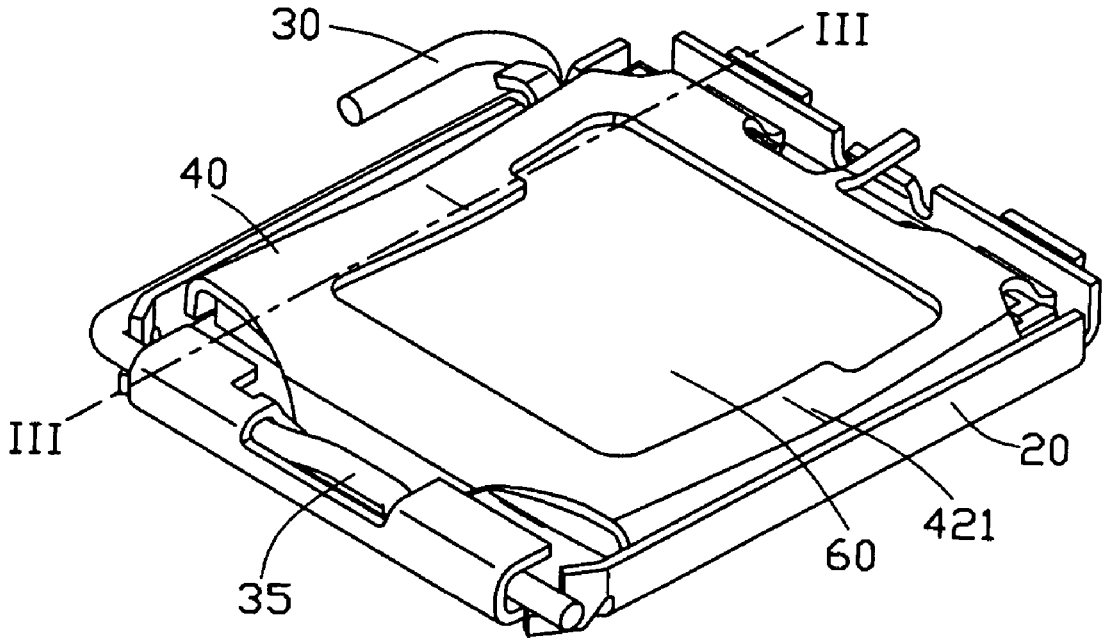
FIG. 2 is an assembled, isometric view the connector assembly of FIG. 1.
Figure 3:
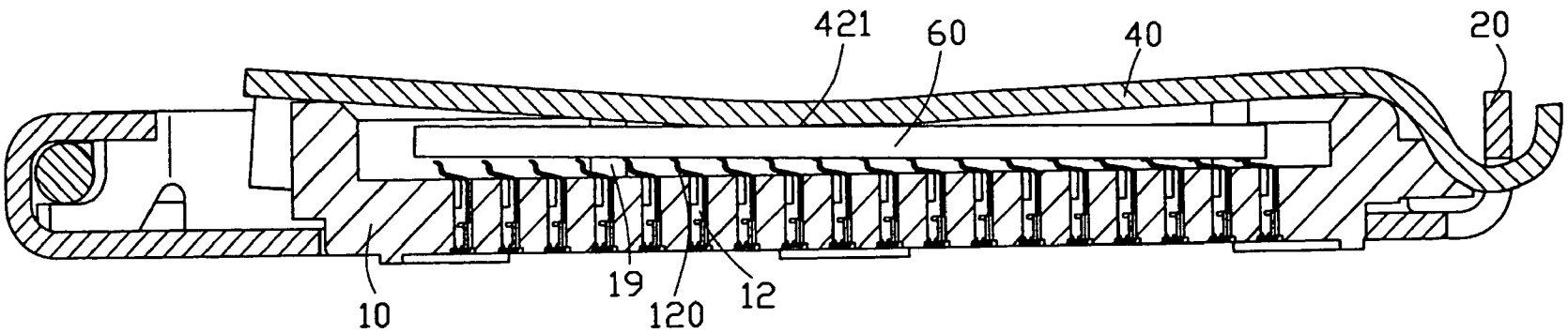
FIG. 3 is a cross-sectional view, taken along line III—III of FIG. 2.
Figure 4:
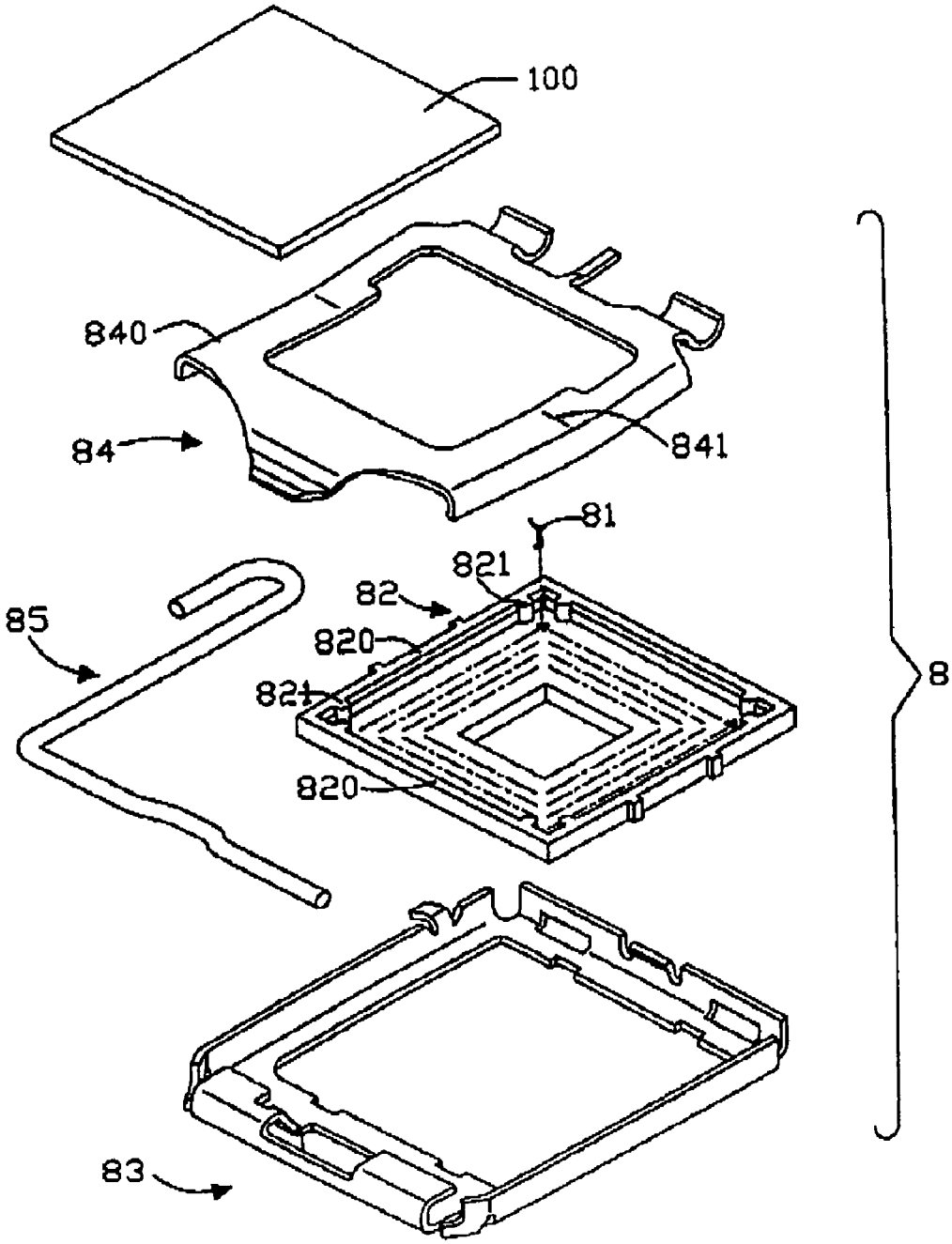
FIG. 4 (PRIOR ART)
FIG. 4 is an exploded, isometric view of a conventional land grid connector assembly, together with an LGA chip.
Figure 5:
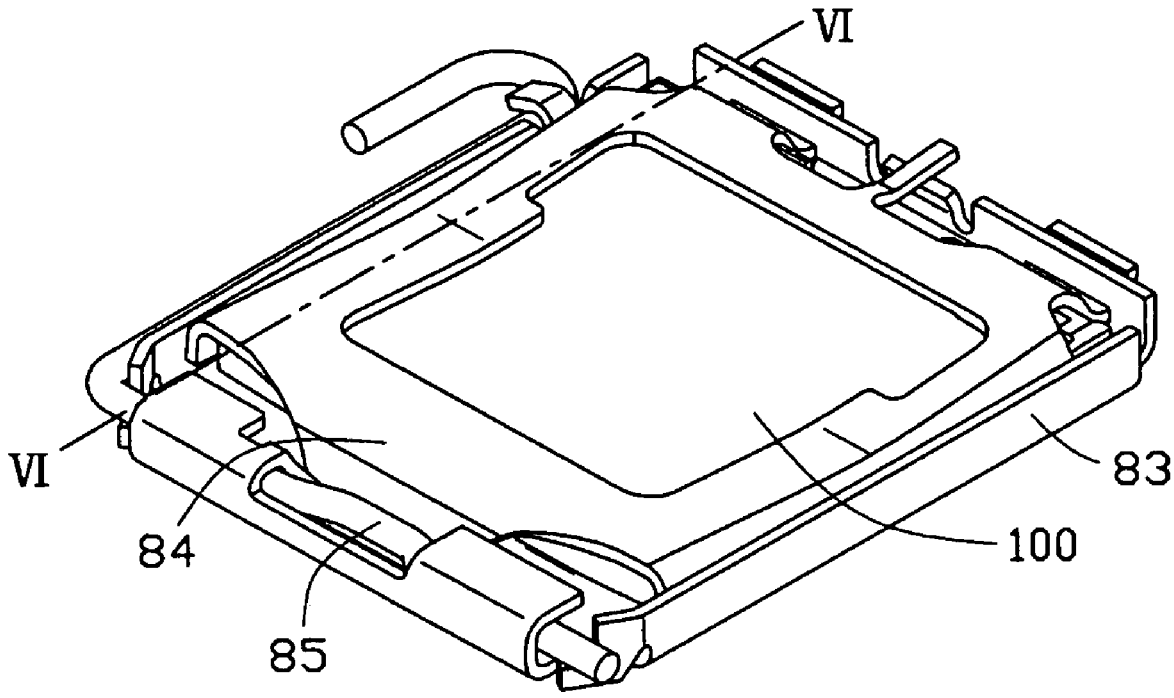
FIG. 5 (PRIOR ART)
FIG. 5 is an assembled, isometric view of the connector assembly of FIG. 4.
Figure 6:
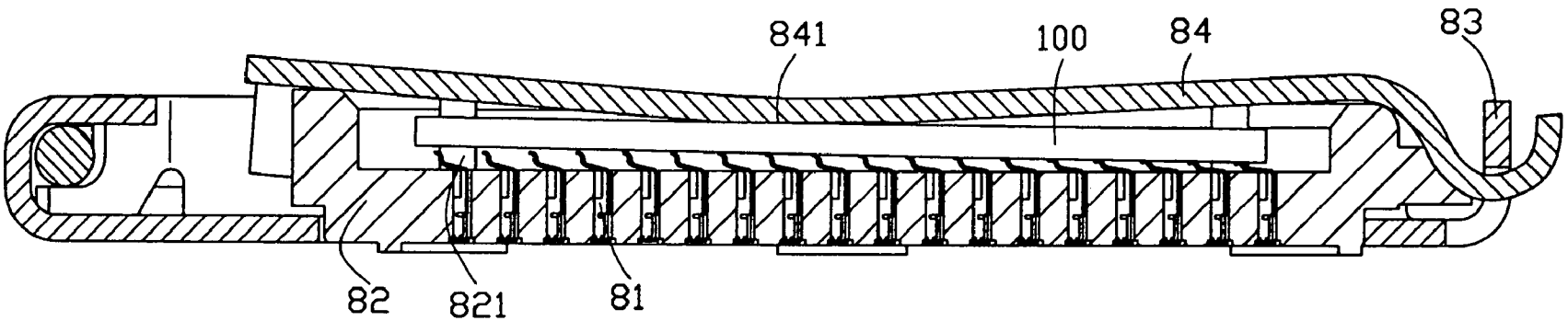
FIG. 6 (PRIOR ART)
FIG. 6 is a cross-sectional view, taken along line VI—VI of FIG. 5.

Referring to FIGS. 1–3, when the LGA chip 60 engages with the connector assembly 1, the clip 40 is oriented at the vertical, one side of the LGA chip 60 firstly touches a first protrusion 18 of the first sidewall 11, then the LGA chip 60 will rotate about the junction between the side of the LGA chip 60 and the first protrusion 18 until the LGA chip 60 is fully received in the cavity 14. The clip 40 is rotated from the vertical position to the horizontal position, thereby the pressing portion 421 touches on the LGA chip 60. The lever 30 is rotated until the actuating portion 35 touches and presses on the engagement portion 411 of the clip 40, the operating portion 32 of the lever 30 being locked in the locking hook 210 of the stiffener 20 in the end for locking the clip 40. The clip 40 is pressed by the lever 30 and the pressing portion 421 of the clip 40 impacts the LGA chip 60 so that the leads of the LGA chip 60 touches on the terminals 12 received in the housing 10. The force of the clip 40 operating on the LGA chip 60 can maintain a reliable electrical connection between the contacts pads on the LGA chip and respective terminals 12 in the housing 10.

When the pressing portion 421 presses the LGA chip 60 unto the terminals 12, the pressing force applied on the LGA chip 60 will make the LGA chip 60 rotate about a first corner opposite to the corner A downward, and the pressing force applied on the LGA chip 60 will produce a frictional force at an junction between a corresponding side of the LGA chip 60 and the second protrusions 19. The frictional force is prone to make the LGA chip 60 rotate about the first corner opposite to the corner A upwardly relative to the housing 10. Because the second protrusion 19 is formed almost at a corresponding middle portion of the first and second sidewalls 11, 15 and adjacent to the pressing portion 421 of the metal clip 40, the distance between the corner A and the second protrusion 19 is larger than that of between the first corner and the first protrusion 18, the torque produced at the first corner by the frictional force between the LGA chip 60 and the second protrusion 19 is smaller than that of generated by the conventional protrusions 821 and the LGA chip 60, thereby reliably electrical and mechanical engagement at the corner A is obtained. Thus the steady electrical connection between the LGA chip 60 and the connector assembly 1 is obtained.

In addition, rigidity of the housing 10 is improved with the stiffener 20 made of rigid material being equipped on the housing 10. So the two opposite end of the housing 10 will not slope when the clip 40 presses the housing 10 on the center of the housing 10. The force that the housing 10 operates on the clip 40 and the lever 30 will not decrease. The force that the clip 40 operates on the LGA chip 60 will not decrease at same time, so that the steady electrical connection between the leads on the LGA chip 60 and the corresponding terminals 12 in the housing 10 will be ensured.

Although the present invention has been described with reference to a particular embodiment, it is not to be construed as being limited thereto. Various alterations and modifications can be made to the embodiment without in any way departing from the scope or spirit of the present invention as defined in the appended claims.

What is claimed is:

1. A land grid array (LGA) connector assembly comprising:

an insulative housing defining a first sidewall, a second sidewall adjacent to the first sidewall, a third sidewall opposite to the first sidewall, and a forth sidewall opposite to the second sidewall, and a substantially rectangular cavity in a middle thereof, the cavity being adapted for receiving an electronic package therein, the first and second sidewalls each defining first and second protrusions, and the third and forth sidewalls each defining a pair of first protrusions at two opposite ends, each protrusion extending from an inner face of the sidewalls toward to the cavity;

a plurality of electrical terminals received in the housing;

a metal stiffener partly covering and reinforcing with a bottom of the housing;

a cam lever pivotably received in an end of the stiffener;

a metal clip pivotably mounted to an opposite end of the stiffener for engaging with the cam lever and disposed on the housing to press the electronic package upon the terminals and having two opposite first slant side edges, a pressing portion substantially formed in a middle portion of the respective first slant side edge; wherein a corner is formed at a junction connecting the first and second sidewalls, the second protrusion is defined in a middle portion of the first and second sidewalls, adjacent to the pressing portion and relocated away from the corner so that a distance between the first and second protrusions of the first sidewall is smaller than that of between a pair of first protrusions of the third sidewall, when the metal clip presses the LGA chip upon the terminals, the configuration of the second protrusions can decrease the torque produced by a frictional force between the second protrusion of the first sidewall and a corresponding side of electronic package rotates about the first protrusion of the first sidewall when the metal clip downwardly presses the electronic package onto the terminals, thereby providing reliable electrical connection between the package and the terminals.

2. The LGA connector assembly as claimed in claim 1, wherein the first and second protrusions are a semi-cylindrical configuration.

3. The LGA connector assembly as claimed in claim 2, wherein the pressing portion is bent toward the housing.

4. The LGA connector assembly as claimed in claim 3, wherein the clip further comprises two second opposite slant sides adjacent to the first slant side edges, respectively.

5. The LGA connector assembly as claimed in claim 4, wherein an engaging portion is extended arcuately from the second slant side thereof and a pair of spaced securing portions extends arcuately from the second slant side thereof, and a tail between the securing portions.

6. The LGA connector assembly as claimed in claim 5, wherein the stiffener comprises a pair of lateral sides each having a substantially L-shaped cross-section, a front end having a U-shaped cross-section and a rear end having an L-shaped cross-section.

7. The LGA connector assembly as claimed in claim 6, wherein a pair of spaced slots is defined in the rear end for receiving the securing portions of the clip, and a locking hook extends arcuately from an edge of one side of the clip.

* * * * *